United States Patent [19]

Hara et al.

[11] 3,933,198

[45] Jan. 20, 1976

[54] HEAT TRANSFER DEVICE

[75] Inventors: Toshitsugu Hara; Motokazu Uchida, both of Tokyo; Yasushige Kashiwabara, Musashino; Michio Yanadori, Hachioji, all of Japan

[73] Assignee: Hitachi, Ltd., Japan

[22] Filed: Mar. 14, 1974

[21] Appl. No.: 451,286

[30] Foreign Application Priority Data

| | | |
|---|---|---|
| Mar. 16, 1973 | Japan | 48-30116 |
| Apr. 25, 1973 | Japan | 48-46170 |
| May 30, 1973 | Japan | 48-59770 |
| June 8, 1973 | Japan | 48-63892 |

[52] U.S. Cl. ..... 165/32; 165/105; 165/96; 62/333

[51] Int. Cl. ..... F28d 15/00

[58] Field of Search ..... 165/32, 105, 96; 62/333

[56] References Cited

UNITED STATES PATENTS

| | | | |
|---|---|---|---|
| 3,517,730 | 6/1970 | Wyatt | 165/105 X |
| 3,587,725 | 6/1971 | Basiulis | 165/105 X |
| 3,613,773 | 10/1971 | Hall et al. | 165/105 X |
| 3,672,443 | 6/1972 | Bienert et al. | 165/32 |
| 3,738,421 | 6/1973 | Moore, Jr. | 165/32 |
| 3,741,289 | 6/1973 | Moore, Jr. | 165/105 X |

*Primary Examiner*—Albert W. Davis, Jr.
*Attorney, Agent, or Firm*—Craig & Antonelli

[57] ABSTRACT

A heat transfer device comprises two kinds of liquid having different boiling points and specific gravities, said two kinds of liquid being not mutually dissolvable and charged in a vessel so as to form two layers therein in superimposed relation to each other. In the heat transfer device, a large amount of heat is transferred at temperatures above a certain temperature but unidirectionally, while no heat transfer is effected at temperatures below the aforesaid certain temperature. The heat transfer device is suited for use in such apparatus or machines which require a thermally valving function, especially for use in a refrigerator.

11 Claims, 31 Drawing Figures

HEAT TRANSFER DEVICE

This invention relates to a heat transfer device.

Hitherto, for transferring heat from one place to another, it has been commonly practised that a material superior in thermal conductivity is placed to extend between those places so as to transfer heat due to thermal conductivity of the material. To improve the thermal conductivity, the use of a heat pipe has been proposed. In these devices, so far as there exists a temperature difference between two places, heat proportional to that temperature difference is necessarily transferred from the place higher in temperature to the place lower in temperature. If a temperature difference between two places is reversed, it follows that the direction of heat flow is reversed, and heat is transferred in like manner. In those conventional methods, thermal energy to be transferred is dependent on only a temperature difference between two places rather than an absolute value of temperature.

Stated otherwise, the conventional heat pipe ensures transfer of a large amount of heat where a temperature difference between two places is small, but such a heat pipe can not afford a thermal switching function, in which heat transfer does not take place at a temperature below a certain temperature detected, even if a temperature difference between two places is large, while at temperatures above that temperature, transfer of a large amount of heat is possible. Furthermore, the heat pipe of the type described fails to prevent reversed heat flow resulting from the reversed temperature difference relationship between two places. For affording the thermal switching function for the conventional methods, it is required that a thermal detector be provided, and outputs of the thermal detector be electrically amplified, so that part of the heat conductive material may be removed depending upon the signals produced, otherwise, in case of the use of a heat pipe, it is necessary that according to the signals produced by the thermal detector, a valve be closed so as to block vapor flow or liquid flow. These disadvantageously result in increase in size of the device as well as complicated construction, with the lowered reliability and increase in expense.

It is accordingly a primary object of the present invention to provide a heat transfer device, wherein the shortcomings described are avoided, a thermally valving function is afforded and a large amount of heat may be transferred with ease.

A second object of the present invention is to provide a heat transfer device, wherein a thermally valving function is afforded, the operating temperature may be set to a desired value and a large amount of heat may be transferred with ease.

A third object of the present invention is to provide a refrigerator, wherein a heat transfer device as has been described is incorporated therein, and two or more compartments thereof are maintained perfectly independent from one another in the sense of air circulation, with a temperature in individual compartment being set to a desired value, without causing air circulation therebetween or thereamong.

According to the present invention, there is provided a heat transfer device comprising; a thermal transfer medium (for example, refrigerant) for transferring heat from a heating section to a cooling section; and liquid having a specific gravity smaller than the thermal transfer medium and being sufficiently low in vapor pressure at a boiling temperature of said thermal transfer medium, said liquid being not dissolvable in the thermal transfer medium, said thermal transfer medium and said liquid being charged (for example, sealingly charged) in a vessel under a proper pressure which is determined in accordance with an operating temperature of the device as well as a saturated vapor pressure of said thermal transfer medium, thereby forming two layers therein in superposed relation to each other. The level of said liquid forming an upper layer of the two layers is maintained without being salient into the cooling section in a non-operation condition. In the operation of the heat transfer device thus constructed, a large amount of heat may be transferred at temperature above a given temperature but unidirectionally, while at temperatures below that temperature no heat transfer takes place.

Figure 1:
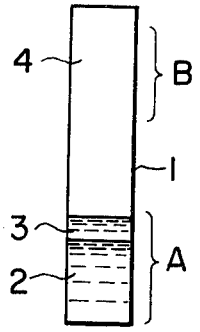
FIG. 1 is a sectional view diagrammatically showing a preferred embodiment of the present invention.

FIG. 1 is a sectional view showing the outline of a heat transfer device according to an embodiment of the present invention. Shown at 1 is a vessel, in which a thermal transfer medium is charged and which serves as a heat passage. Denoted at 2 is a heat transfer medium, for example a refrigerant, for transferring heat from a heating section A of the heat transfer device to a cooling section B, at 3 liquid having a specific gravity smaller than the heat transfer medium 2 and being sufficiently low in vapor pressure at a boiling point of the heat transfer medium, said liquid being not dissolvable in the heat transfer medium 2. The heat transfer medium 2 and the liquid 3 are charged or sealingly charged in the vessel 1 under an adequate pressure which is determined in accordance with an operation temperature of the device as well as a saturated vapor pressure of the heat transfer medium 2, thereby forming two layers therein in which an upper layer is said liquid 3 and a lower layer is said heat transfer medium 2. A level of said liquid forming the upper layer of two layers is maintained without being salient into the cooling section in an inoperative condition of the device. The liquid layer 3 is placed on the heat transfer medium 2 in superposed relation thereto and has such a thickness that boiling bubbles generating in the heat transfer medium 2 may pass through the liquid layer 3 without being condensed by the liquid 3. 4 is non-condensable gas such as air which covers the two layers of heat transfer medium 2 and liquid 3 as shown. The charging pressure is established, for example, by use of the non-condensable gas 4.

In operation, if a temperature in the refrigerant 2 rises due to heat applied from a certain heat source to the heating section A of the vessel 1, neither boiling of the refrigerant 2 will be caused until the saturated vapor pressure thereof is raised to a level more than a level of the charged pressure, nor evaporation of the refrigerant will be caused because of being suppressed by the upper layer of liquid 3. Therefore, if refrigerant 2 is heated, no vapor which travels in the vessel to the upper space thereof generates as far as a temperature of the refrigerant does not reach a certain degree where boiling is caused, and hence the heat is transferred only by way of walls of the vessel 1 due to the thermal conductivity thereof without risk of the heat of being transferred by vapor to the upper portion of the vessel. If the vessel 1 is made of a material presenting a low thermal conductivity and has a thin wall in thickness, heat energy transferred to the upper space will be reduced to a greater extent.

When refrigerant 2 is heated to a temperature above a certain temperature, and the saturated vapor pressure rises to a level more than the level of the charged pressure, the refrigerant 2 starts boiling, whereupon boiling bubbles will be produced therein. The bubbles thus produced start ascending due to their buoyancies through the liquid layer 3 superposed on the refrigerant layer 2, and eventually reach the upper space of vessel 1. Since vapor involves latent heat of vapor, the flow of refrigerant vapor 2 from the lower portion A of vessel 1 to the upper portion B thereof will result in the fact that heat is transferred from the lower portion A to the upper portion. In this case, if proper heat rejection means is provided in the upper portion of vessel 1, it follows that heat is transferred from the heat source in the lower portion to the heat rejection means in the upper portion.

It is well known such as in the case of the heat pipe that by utilizing the boiling phenomenon in the refrigerant, a large amount of heat may be transferred efficiently. Accordingly, it will be readily understood that heat is scarecely transferred when the refrigerant temperature is below the boiling point, while at the temperatures above the boiling point, transfer of heat of a large amount rapidly takes place. It is known that vapor produced from the boiling refrigerant becomes condensed for liquidization when cooled in the upper portion of the vessel. The refrigerant thus liquidized drops due to its gravity, past the liquid layer 3, down-to the refrigerant layer 2 to be recovered therein. Thus, the refrigerant 2 circulates within the vessel.

Figure 2:
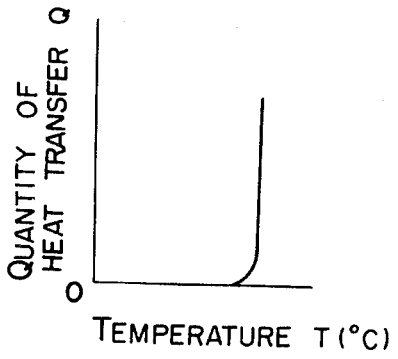
FIG. 2 is a plot representing an operating characteristic of the device of FIG. 1.

FIG. 2 shows a plot obtained through the test carried out by using fluoro-carbon as refrigerant 2 and silicon oil as the liquid 3, wherein temperature T is given as the abscissa and an amount of heat to be transferred Q is given as an ordinate. The results show that the performance has been satisfactory. Since the refrigerant 2 remains unboiled, even if the upper portion of vessel 1 is heated, then there occurs no vapor flow in the vessel 1, and hence no heat transfer is caused between the upper and lower portions of vessel 1. Thus, it will be understood that the heat transfer device presents a characteristic akin to the electric diode characteristic with respect to heat flow, without resorting to a thermal detector or a valve, thus resulting in simplified construction.

Figure 5:
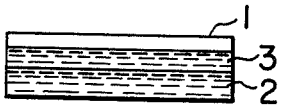
FIGS. 5 through 20 are longitudinal cross-sectional views illustrating the outline of further embodiments; and, FIGS. 21 through 31 are longitudinal cross-sectional views showing the outline of examples, in each of which the heat transfer device of the present invention is incorporated.
Figure 6:
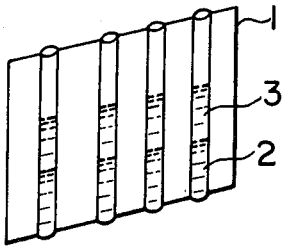
Figure 7:
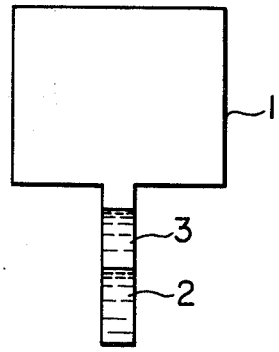

The vessel 1 may be made of any material and in any shape, because the heat transfer device is independent of such factors. For example, a metallic material, such as steel, may be availed as a material for the vessel, if a thickness may be reduced to a greater extent, while ceramics or glass may be used. The requirement for the vessel is such that the vessel can withstand the charged pressure and saturated vapor pressure of refrigerant within a range of operating temperatures. The vessel may be of any configuration, such as a cylinder or prism. Or otherwise, a shallow box shape is acceptable as shown in FIG. 5. It is also possible to use two sheets of corrugated plate, in which case the two sheets of corrugated plate are bonded together in a manner to form flute-like channels therebetween so that two kinds of liquid may charged in each of channels, as shown in FIG. 6. The upper portion and the lower portion of the vessel may be different in cross-sectional area. For instance, as shown in FIG. 7, the lower portion in which the refrigerant and the liquid are charged is reduced in cross sectional area, with the upper space being relatively large. Such configuration will bring about advantages that a quantity of liquid required is small, and that should the heat transfer device be heated to an abnormally high temperature, there would be no risk of causing an abnormal rise in the internal pressure, and hence the safety is ensured. The longitudinal length of the vessel may be increased. However long the vessel may be, heat will be transferred over the entire length thereof instantly and substantially at a uniform temperature due to vapor flow.

In the foregoing, the vessel is described as if the use of a sealed vessel would be a requisite. However, where it is allowable to expose the refrigerent 2 to atmosphere, the vessel need not be sealed. Through the tests, it has been proven that in case of an open vessel being used, the curve of FIG. 2 presents a sharp upright portion and the characteristic is improved.

In the foregoing, fluoro-carbon and silicon oil are used as a refrigerant 3 and as a liquid 2, respectively. However various combinations of refrigerant 2 and liquid 3 are possible. For example, a combination of alcohol or water and insulating oil is available as a combination of the refrigerant and the liquid, respectively.

The refrigerant should preferably be great in latent heat of vapor, and the type of refrigerant is dependent on the operational temperature condition. Only the requirement for the refrigerant is that the specific gravity thereof is greater than the liquid 3. The requirement for the liquid 3 is such that the liquid to be used be not dissolvable in the refrigerant used 2, has a specific gravity smaller than the refrigerant 2 and be low in vapor pressure at an operating temperature.

The charged pressure is established by the use of non-condensable gas or the like. In the foregoing, the case is shown where air is used. The use of air is no limitative but inactive gas may be used.

Figure 8:
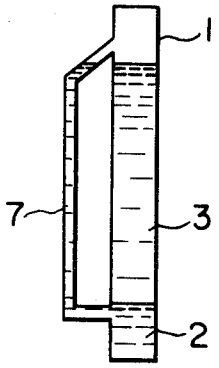

In the embodiments described, the cases are shown in which the two kinds of liquid are charged in a single pipe. As shown in FIG. 8, another pipe 5 may be separately provided for recovering the liquid from the upper portion of the vessel to the lower portion. The number of the recovery pipe 5 may be plural. The provision of a plurality of pipes will bring about advantageous that these pipes serve as fins for heat-exchange, and at the same time, the descending liquid flow may be separated from the ascending vapor flow, with the freedom of interference therebetween, with the result of facilitating the recovery of the refrigerant. In FIG. 8, a large quantity of liquid is used, and the performance of the heat transfer device of the present invention is independent of the quantity of liquid.

Further embodiments will hereunder be referred to.

Figure 9:
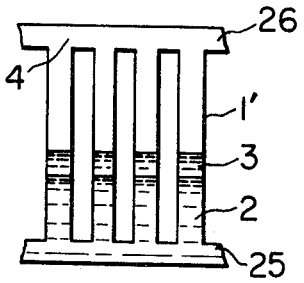

The heat transfer device shown in FIG. 9 comprises a plurality of heat transfer pipes 1' and an upper and lower pipes 25 and 26 which interconnect these pipes.

Figure 10:
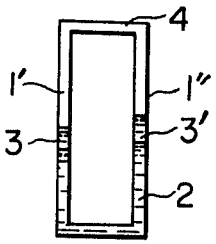

The two kinds of liquid are sealingly charged in these heat transfer pipes. This contributes to providing an increased heat transfer area. FIG. 10 shows the heat transfer device of an endless ring-shape, in which vapor from the boiling refrigerant charged in the lower portion of pipe ascends through the heat transfer pipe 1' towards the upper space, for being subjected to condensation and is returned as liquid through the other pipe 1'' to the refrigerant layer 2. In this case, the vapor passage is provided separately from the liquid passage for avoiding the interference between the vapor flow and the liquid flow, such that fluid resistance will be reduced. The heat transfer device of FIG. 10 may be arranged in a manner as shown in FIG. 9. In the embodiment of FIG. 10, the heat transfer pipes 1' and 1'' are arranged in parallel relation to each other, and either of pipes may be inclined at a certain degree to the horizontal direction. Both pipes 1' and 1'' may be made of a material of quite the same composition or may be made of a material of totally different composition. In either case, the performances resulting are quite the same.

Figure 11:
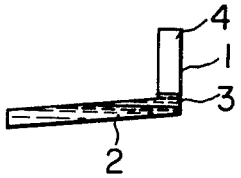

The heat transfer device shown in FIG. 11 comprises a horizontally arranged pipe. The horizontal pipe may be slightly inclined for facilitating vapor circulation. Such arrangement of pipe, even if it is adopted from the viewpoint of improvements in its outer appearance, will not impair the features and function of the device of the present invention.

Figure 12:
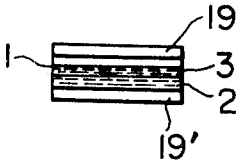

In the heat transfer device of FIG. 12, the vessel 1 is of a shallow box type having a rectangular, circular or any desired shape in cross section, in which the refrigerant 2 and the liquid 3 are sealingly charged in superposed relation to each other. Where reduction in size of the device is desired, a single or plural fins 19 or 19' may be attached to one side or both sides of the device. Where a large size of device is desired, such a fin need not be attached thereto.

Figure 13:
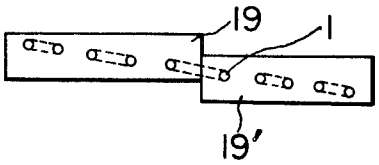

In the heat transfer device of FIG. 13, the vessel 1 consists of pipes arranged in zig-zag relation to each other. If the pipes are slightly declined, with respect to the horizontal line, the heat transfer device will provide the same result as the device of FIG. 12. In addition, the heat transfer device of FIG. 13 is free from the shortcoming experienced with that of FIG. 12 that the two kinds of liquid charged in the device may be admixed with each other when vibration is given to the device, resulting in the failure to effect heat transfer.

It will be clearly understood from the foregoing that according to the present invention, the heat transfer device is simple in construction and afforded a thermally valving function which detects a temperature with respect to flow of heat as well as a check valving function.

In the heat transfer device as shown in the preceding embodiments, since the boiling point of refrigerant 2 is basically determined according to the charged pressure in the vessel, it is impossible to alter or adjust the boiling point of refrigerant 2 after pressure has been charged in the vessel. For adjusting the boiling point, the vessel must be opened to remove non-condensable gas therefrom.

The following embodiments are so designed that pressure in the vessel may be varied, with the refrigerant 2 and other liquid being sealingly charged therein.

Figure 3:
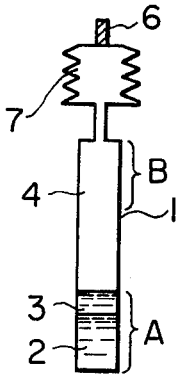
FIG. 3 is a sectional view diagrammatically showing another embodiment of the present invention.

In a heat transfer device of FIG. 3, the vessel 1 is partly made of a flexible pipe or plate 7, on which is applied a force by any suitable pressing means 6 such as a rod or plate. Since the boiling point of the refrigerant is determined to a given value according to the internal pressure, where the set temperature, i.e. the set internal pressure, is desired to be altered after the refrigerant 2, the liquid 3 and non-condensable gas 4 have been sealingly charged in given amounts in the vessel 1, the pressing means 6 is operated so as to urge the flexible portion 7 downwards or to pull same upwards. If the flexible portion 7 is urged downwards by the pressing means 6, the non-condensable gas in the vessel will be compressed, and thus pressure in the vessel will rise. Consequently, the saturated temperature of the refrigerant 2 will rise, resulting in rise in the set temperature. If the pressing means 6 is pulled upwardly, the set temperature becomes lowered, in like manner.

Figure 4:
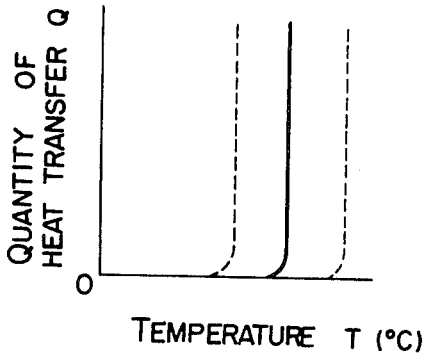

The results of the test carried by using fluoro-carbon and silicon oil as refrigerant 2 and as the liquid 3, respectively, are given in FIG. 4, wherein the temperature is given as an abscissa and the quantity of heat transfer Q is given as an ordinate. A temperature, at which a valving action takes place, varies, as shown by the dotted lines, with changes in the condition of the flexible portion 7.

Figure 14:
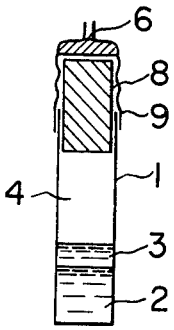
Figure 15:
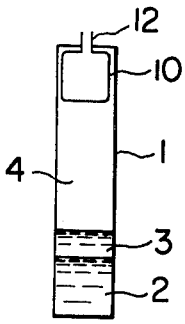
Figure 16:
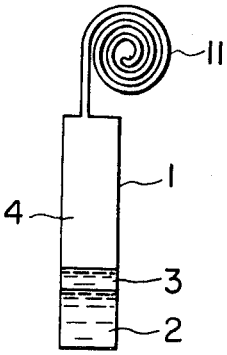

FIGS. 14 through 16 show further embodiments of the present invention. The heat transfer device of FIG. 14 is so constructed that a movable plug 8 such as a piston is inserted to a certain extent in the vessel by operating the pressing means 6 so as to vary the pressure of non-condensable gas in the vessel. Shown at 9 is a flexible cover. In FIG. 15, a flexible, relatively small vessel 10 is provided in the vessel 1, in which small vessel 10 is charged liquid or air from outside the vessel. The liquid pressure or air pressure in said small vessel is controlled so as to vary the volume of said small vessel 10, thereby varying the pressure of non-condensable gas 4. In the embodiment of FIG. 16, a coiled pipe connected to the vessel 1 is unwound so as to vary the inner volume of the vessel 1. In place of the coiled pipe, the vessel 1 may be formed to a tubular shape as a dental-cream tube variable in its volume. The vessel 1 may be formed to a box shape.

The embodiments described are the cases that the upper space of vessel varies in various ways. The same result will be obtained by raising the liquid level.

Further embodiments are shown in FIGS. 17 through 20, in which the liquid level is changed for varying the volume of upper space of the vessel.

Figure 17:
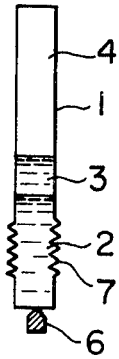
Figure 18A:
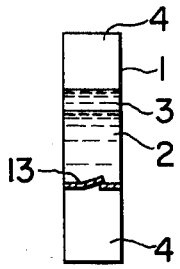
Figure 18B:
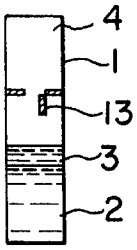
Figure 19:
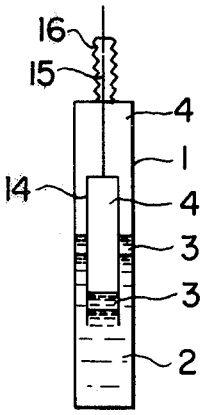
Figure 20:
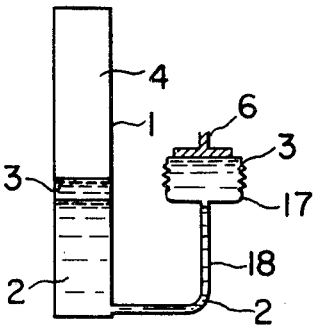

The heat transfer device of FIG. 17 has the vessel 1 having a flexible lower portion 7. The flexible lower portion 7 is forced upwards or pulled downwards by the use of the pressing means 6, whereby the liquid level in the vessel changes. FIG. 18 shows a further modification of the present invention, wherein a valve 13 is provided in a portion of vessel 1. In the condition of FIG. 18(*a*), the valve 13 is maintained close, such that the refrigerant 2 and the liquid 3 remain in the mid portion of the vessel, with the liquid level being positioned at a level higher than the other embodiment. On the other hand, in the condition of FIG. 18(*b*), the valve 13 is maintained open such that the refrigerant 2 and the liquid 3 are lowered, with the refrigerant 2 reaching the bottom of vessel, whereby the liquid level is lowered. In the embodiment of FIG. 18, the two different values of temperature may be determined by inverting the vessel 1. The device of FIG. 19 is so constructed that a relatively small vessel 14 having an open lower end is inserted in the vessel 1, and the shaft 15 is pressed downwardly or pulled upwardly so as to shift the liquid level downwardly or upwardly. FIG. 20 shows a construction that the refrigerant 3 and the liquid 2 are all or partly charged in another liquid tank 17 connected by way of a connecting pipe 18 to the vessel 1, and another liquid tank 17 is urged by the pressing means 6 so as to adjust the liquid level in the vessel 1.

With the constructions as shown in FIG. 3 and FIGS. 14 through 20, the volume of inner space of vessel 1 is changed for adjusting pressure in the vessel so as to vary the saturated temperature. According to the test carried out by using the heat transfer device having the construction shown in FIG. 3, the saturated temperature was variable within a range from −2°C to +5°C.

As is apparent from the embodiments described, the saturated temperature is determined to a desired value, without impairing the function of the heat transfer device using the two kinds of liquid.

The embodiments described are merely shown for exemplification. Any construction, so far as it is so designed as to vary the pressure in the inner space of vessel, will be available for changing the temperature which provides a valving function.

The heat transfer device of the present invention is suited for a refrigerator. Embodiments will be given hereunder.

In case a refrigerator is incorporated in the heat transfer device of the present invention which is simple in construction and performs a satisfactory control function, a power required for the refrigerator will be greatly reduced, and the ease in the use of the refrigerator will be enhanced.

Figure 21:
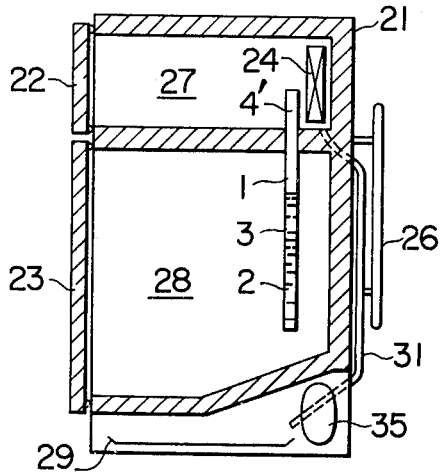

FIG. 21 illustrates a principle of a refrigerator in which the heat transfer device of the present invention is incorporated. The heat transfer device extends through a freezing compartment 27 and a refrigerating compartment 28, piercing through a partitioning wall provided therebetween, with its lower portion being located in the refrigerating compartment and with its upper portion being positioned in the freezing compartment. The heat transfer device to be incorporated in the refrigerator has no particular limitation either in size or in position with respect to the refrigerator. In the embodiment of FIG. 21, a greater part of the heat transfer device is located in the refrigerating compartment 28, while only a small part thereof is located in the freezing compartment 27, whose wall is in contacting relation to the wall of evaporator. Thus, the freezing compartment 27 and the refrigerating compartment 28 are maintained independent from each other from the viewpoint of circulation of air. With the construction, heat from the freezing compartment 27 is subjected to cooling in the evaporator 24. Let us consider that the temperature in the refrigerating compartment 28 is raised to a value above the specified value. The specified value, in most cases, is determined in consideration of the function required for a refrigerator and usually ranges from 2° to 5°C. But in the embodiment, such a specified temperature may be of any value. When the temperature in the refrigerating compartment 28 is raised to a value above the specified value, the refrigerant 2 charged in the heat transfer device starts boiling, and vapor reaches the upper space 4' of heat transfer device located in the freezing compartment 27, whereby heat in the refrigerating compartment 28 is transferred to the upper space of heat transfer device located in the freezing compartment 27 and then applied to the evaporator through the wall of the device. Thus, heat in the refrigerating compartment is cooled by the evaporator 24, whereby the temperature therein is lowered. When temperature in the refrigerating compartment is lowered to a value below the specified value, the upper portion of heat transfer device is thermally intercepted from the lower portion, such that the freezing compartment and the refrigerating compartment are completely thermally intercepted from each other, and hence there is no risk that the refrigerating compartment will be cooled to a temperature below the specified value. Shown at 31 is a pipe.

In the refrigerator shown in FIG. 21, the freezing compartment is maintained independent of the refrigerating compartment in the sense of air circulation, and neither thermal detector nor control circuit is needed, since the heat transfer device itself serves as a thermal detector and as a control device with respect to heat flow. The refrigerator thus obtained is lessened in the frost formations, well controllable and reduced in manufacturing cost.

In the embodiment of FIG. 21, the heat transfer device is arranged in the refrigerator, with its upper portion maintained contacting relation to the evaporator. This is for the sake of reducing a thermal resistance between the heat transfer device and the evaporator. The heat transfer device need not be positioned in contacting relation to the evaporator but may be positioned anywhere. The heat transfer device need not be of a single pipe but of a plurality of pipes arranged in parallel relation to each other. The configuration of the vessel need not be of a tubular shape but may be of a square shape in cross section.

Figure 22:
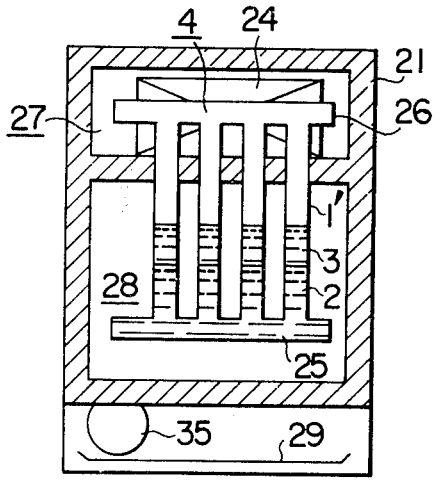

FIG. 22 is a longitudinal cross-sectional side elevational view of a refrigerator, illustrating the outline thereof, in which the heat transfer device shown in FIG. 9 is incorporated. Shown at 21 is a thermal insulating wall which surrounds the outer periphery of the refrigerator. In this embodiment, the heat transfer device is composed of a plurality of heat transfer pipes 11 extending between the freezing compartment 27 and the refrigerating compartment 28, and the upper and lower pipes 25 and 26 which are connected to said plurality of pipes so as to communicate same with one another. The two kinds of liquid are charged in said pipes, as set forth in conjunction with FIG. 9. This contributes to providing an increased heat transfer surface.

Figure 23:
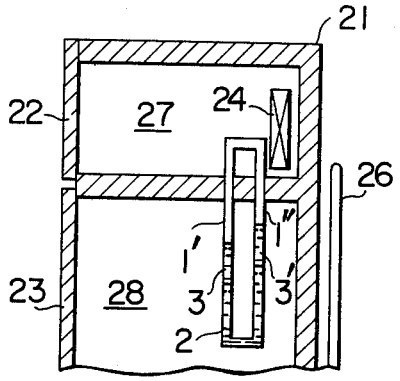

FIG. 23 is a longitudinal cross-sectional side elevational view of a refrigerator in which the heat transfer device shown in FIG. 10 is incorporated. In the embodiment, the heat transfer device consists of a ring-shaped or an endless single pipe, in which vapor from the refrigerant ascends by way of the heat transfer pipe 1' towards the upper space, then is subject to condensation therein and returned as droplets by way of the heat transfer pipe 1'' located on the other side to the refrigerant layer. This is an example in which the vapor passage is separated from the liquid passage for avoiding interference between vapor and liquid, so as to reduce fluid resistance. The heat transfer device of the type may be arranged in a manner as shown in FIG. 22.

Figure 24:
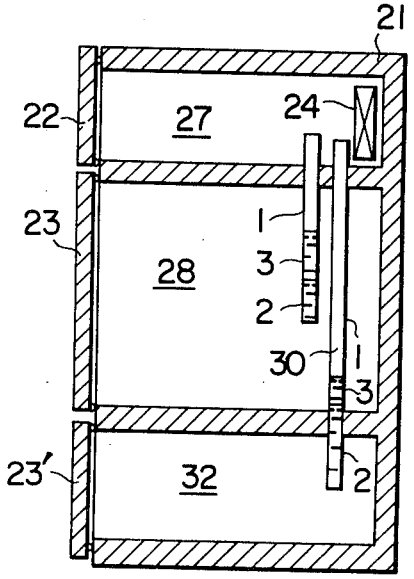

FIG. 24 illustrates a further embodiment, in which there is shown a refrigerator of three-compartment type, although in the preceding embodiments there are shown refrigerators of a two-compartment type only. In the embodiment, there are incorporated two types of heat transfer devices which are different in an operating temperature, such that three compartments may be maintained individually differently in a temperature condition, or otherwise two compartments 28 and 32 may be maintained in the same temperature condition but different in a moisture condition, i.e. the refrigerating compartment 32 is maintained in a high moisture condition for providing a condition suited for storage of vegetables and fruits. In this case, a thermal insulating treatment should preferably be applied to a portion of the heat transfer device which is positioned in the refrigerating compartment 28. It will be apparent that the different types of heat transfer devices in combination are applicable for a three-compartment type refrigerator, without the use of a thermal detector and a control circuit.

Figure 25:
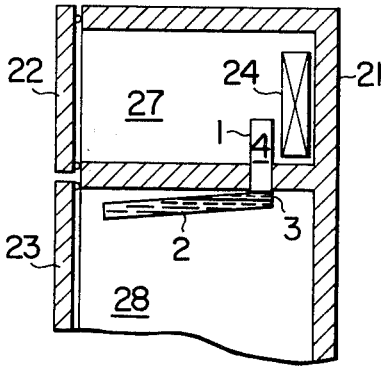

FIG. 25 shows a further embodiment of a refrigerator in which the heat transfer device shown in FIG. 11 is incorporated. In the preceding embodiments, the heat transfer device is arranged in vertical relation to the refrigerator, while in the embodiment, the heat transfer device is arranged with its lower portion extending horizontally in the refrigerating compartment 28. The lower portion of heat transfer device should preferably be slightly inclined with respect to the horizontal surface of refrigerator, so as to facilitate circulation of vapor from boiling refrigerant. Where it is desired to arrange the lower portion of heat transfer device horizontally, from the viewpoint of the function of a refrigerator or improvement in an outer appearance thereof, without a risk of impairing the features and functions of the present invention.

Figure 26:
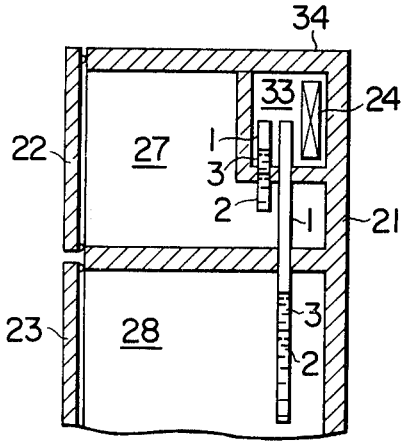

FIG. 26 illustrates a further embodiment, in which the evaporator 24 is housed in a small compartment 33, whose peripheral wall is surrounded by a thermal insulating wall 34, although the evaporator 24 is exposed to air of the freezing compartment 27 in the preceding embodiments. The two types of heat transfer device are independently housed in the small compartment 33, with one heat transfer device extending in the freezing compartment and the other extending by way of the freezing compartment to the refrigerating compartment. Such arrangement reduces the space which is to be defined by a thermal insulating wall, such that an insulating material superior in the thermal insulating property may be used for the wall, with the result of reduction in a power for cooling a small compartment. The small compartment is maintained air-tight so as to prevent ingress of atmosphere thereinto, such that the frosting on the evaporator surface will be avoided. This will contribute to improving performance of the evaporator, rather than reducing coefficient of thermal conduction in the evaporator surface. These factors also permit reduction in capacity of a compressor 35 as well as permit a continuous operation of the compressor, without the necessity of interrupting its operation. Since the on-off control for the compressor is not necessary, neither thermal detector, nor a control means, nor switch means is needed, and thus a refrigerator low in manufacturing cost and with reliability in performance may be provided. Even if the on-off control type compressor is used in the refrigerator of this embodiment, an electric power required for the compressor is greatly reduced, as compared with that for the conventional one. This contributes to diminishing a size of the control means. The heat transfer device to be incorporated in the refrigerator may be of any configuration and may be arranged in a desired manner, as described in FIG. 25. In addition, the heat transfer device may be used either for a two-compartment type refrigerator or for a three-compartment type refrigerator.

Figure 27:
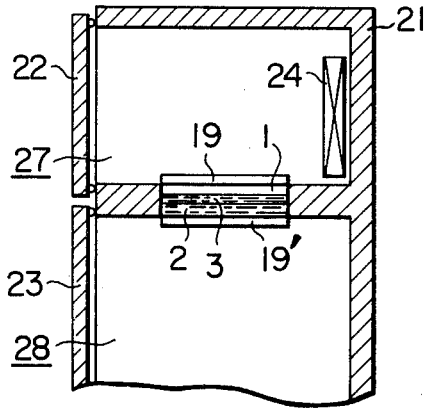

FIG. 27 shows a further embodiment of a refrigerator, in which the heat transfer device shown in FIG. 12 is incorporated. In the preceding embodiments, vertically elongated type heat transfer devices are used, while in the embodiment, a horizontally elongated, shallow box type is used. The shallow box type heat transfer device is quite the same in the heat transfer characteristic, which is apparent from a principle and the test heat transfer device described in the foregoing. In this embodiment, the vessel 1 of heat transfer device is of a shallow box type having a rectangular, circular or any other shape in cross section, and the refrigerant 2 and the liquid 3 are charged therein in superposed relation to each other. The heat transfer device, in this embodiment, is disposed on the boundary between the freezing compartment 27 and the refrigerating compartment 28 in a manner to constitute part of a partition wall provided therebetween or to extend over the entire length thereof for substituting for the partition wall. For reducing a size of the heat transfer device, a single or plural fins 19 or 19' may be provided on either side or both sides of heat transfer device. Where a large size of heat transfer device is desired, such a fin need not be provided. With such arrangements, the heat transfer device will start operating immediately the air heated ascends upwards from the lower portion of refrigerator, and then the air cooled descends downwards, such that the uniform temperature distribution in the refrigerator will be ensured.

Figure 28:
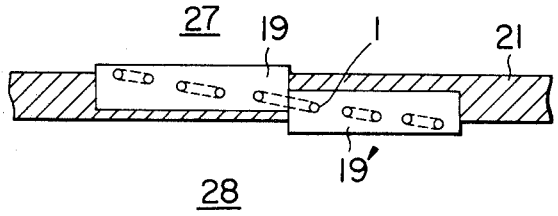

FIG. 28 shows a still further embodiment of a refrigerator, in which the heat transfer device shown in FIG. 13 is incorporated. In the device of FIG. 27, the two kinds of liquid charged in the heat transfer device may be probably admixed with each other due to agitation resulting from vibration at high level if it is given to the refrigerator or the device itself. To avoid such a shortcoming described, a plurality of tubular heat transfer devices are disposed in zig-zag relation to span the respective fins 19 and 19' arranged in side by side relation to each other, with one of tubular heat transfer device extending between opposed fins. If these devices are slightly inclined with respect to respective fins, there will be obtained the same performance as in the device of FIG. 27, with the freedom of the above-described shortcoming.

In the refrigerators exemplified in the foregoing, the boiling point of the refrigerant 2 is principally determined according to the pressure at the time of non-condensable gas charging. Accordingly, for changing or adjusting the boiling point of the refrigerant after non-condensable gas has been charged, it is necessary to open the vessel for adjusting the pressure of non-condensable gas. It is a requirement for a refrigerator that adjustment of a determined temperature be permitted. To meet the requirement, the above-described shortcoming must be overcome.

In the following, there will be given examples of a refrigerator so constructed that, with the refrigerant 2 and the liquid being sealingly charged in the vessel 1, the internal pressure in the vessel 1 may be adjusted, i.e. a determined temperature may be adjusted.

Figure 29:
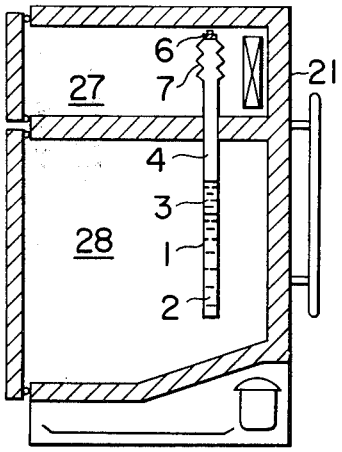

FIG. 29 shows an embodiment of a refrigerator in which the heat transfer device shown in FIG. 3 is incorporated. The heat transfer device pierces through the partition wall to extend between the freezing compartment 27 and the refrigerating compartment 28, with its upper portion being located in the freezing compartment 27 and with its lower portion being positioned in the refrigerating compartment 28. The feature of the embodiment lies in that the vessel 1 has a flexible portion in its upper portion and pressing means 6 attached to the upper end of said flexible portion. As set forth in conjunction with FIG. 3, if the pressing means 6 is pressed downwards, the determined temperature may rise, while if the pressing member 6 is pulled upwards, the temperature may be lowered. According to the results of the test carried out by using fluoro-carbon R-114 as the refrigerant 2, the volume of non-condensable gas was changed by 4 percent.

Figure 30:
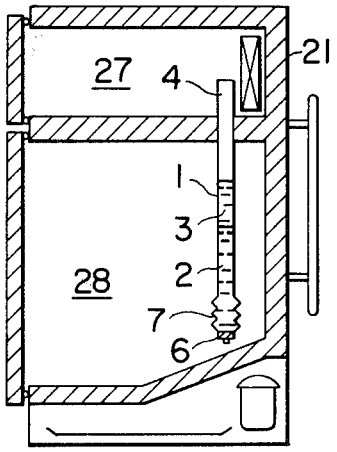

FIG. 30 shows a further embodiment of a refrigerator, in which the heat transfer device as shown in FIG. 17 is incorporated. In this embodiment, the vessel 1 has a flexible lower portion 7, and the pressure of non-condensable gas in the vessel is changed by shifting the liquid level upwardly or downwardly by the operation of the pressing means attached to the lower end of flexible portion. The result was quite the same as the embodiment of FIG. 29.

Figure 31:
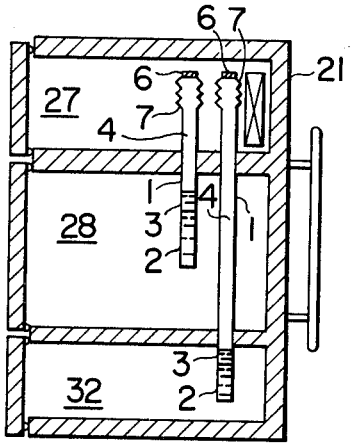

FIG. 31 shows an embodiment of a three-compartment type refrigerator, although a two-compartment type, two temperature system refrigerator is shown in the preceding embodiments. In this case, two heat transfer devices different in an operating temperature may be used so as to provide a different temperature for individual compartment. The temperature in individual compartment will be adjusted independently from one another by expanding or contracting the flexible portion 7 of each vessel 1.

Throughout the specification, although a flexible portion 7 is shown as a flexible tube (for example, a bellows) for descriptive convenience, the flexible portion is not limitative to a bellows, but may be of any desired shape such as a piston shape, a rubber-made spherical member, a spiral shape or a member of a check-valve shape.

For the convenience of illustration, only a tubular type vessel is shown, and a vessel of any configuration is applicable.

As is apparent from the foregoing, the basic requirement for the refrigerator incorporated in a device of the present invention is to use a heat transfer device containing therein two kinds of liquid, and hence the configuration of a heat transfer device itself is optional. For example, whether or not to provide a fin in the heat transfer device or to provide a fan in a refrigerator — it depends upon the function required for the refrigerator. The function of the heat transfer device of the present invention is independent of whether or not such a fan or fin is provided therein. According to the refrigerator incorporated therein the device of the present invention, the freezing compartment is perfectly independent of the refrigerating compartment in the aspect of air circulation, such that the frosting is lessened, and foods are maintained in a good refrigerating condition, free from being dried up. The heat transfer device of the present invention is particularly suited for provided a refrigerator which is superior in performance and simple in construction, without the use of a thermal detector, an expensive control circuit.

The application of the heat transfer device of the present invention is not limitative to a refrigerator but the device is available for various apparatus where a thermal valve function is needed, such as various types of air conditioner and ice making machines.

What is claimed is:

1. In a heat transfer device, the improvements comprising; a vessel having a heating section and a cooling section; a thermal transfer medium for transferring heat from said heating section to said cooling section; and a liquid body having a specific gravity smaller than said thermal transfer medium and being low in vapor pressure at a temperature corresponding to the boiling point of said thermal transfer medium, said liquid being not dissolvable in said thermal transfer medium; said thermal transfer medium and said liquid being charged in said vessel under an adequate pressure which is determined in accordance with an operating temperature of the device and a saturated vapor pressure of said thermal transfer medium, thereby forming two layers therein, a level of said liquid forming an upper layer of said two layers is maintained without being salient into said cooling section.

2. In a heat transfer device, the improvements comprising; a vessel consisting of a heating section and a cooling section; a thermal transfer medium for transferring heat from said heating section to said cooling section; and a liquid body having a specific gravity smaller than said thermal transfer medium and being low in vapor pressure at a temperature of boiling point of said thermal transfer medium, said liquid having property of non-admixing with said thermal transfer medium; said thermal transfer medium and said liquid being charged in said vessel under an adequate pressure which is determined in accordance with an operating temperature of the device and a saturated vapor pressure of said thermal transfer medium, thereby forming two layers therein, and two layers having a liquid surface a level of which is maintained without being salient into the cooling section, said thermal transfer medium producing boiling bubbles when heat is applied to said heating section, said boiling bubbles passing through the upwardly located liquid layer without being condensed due to a direct heat exchange, entering said cooling section and then being condensed therein, whereby heat is transferred from said heating section to said cooling section.

3. A heat transfer device as defined in claim 1, wherein there is provided means for varying internal pressure in said vessel, with two kinds of liquids which form two layers, being charged in said vessel.

4. A heat transfer device as defined in claim 3, wherein said means consists of a flexible member provided as a portion of said vessel, said flexible member being adapted to be deformed so as to adjust the internal pressure in said vessel.

5. A heat transfer device as defined in claim 1, wherein heat is transferred from said heating section to said cooling section without a boiling surface of said two-liquid layers reaching said cooling section.

6. A heat transfer device as defined in claim 1, wherein a non-condensable gas is charged in said vessel and covers the two layers of said heat transfer medium and said liquid therein.

7. A heat transfer device as defined in claim 2, wherein there is provided means for varying internal pressure in said vessel, with two kinds of liquids which form two layers, being charged in said vessel.

8. A heat transfer device as defined in claim 7, wherein said means consists of a flexible member provided as a portion of said vessel, said flexible member being adapted to be deformed so as to adjust the internal pressure in said vessel.

9. A heat transfer device as defined in claim 2, wherein heat is transferred from said heating section to said cooling section without a boiling surface of said two-liquid layers reaching said cooling section.

10. A heat transfer device as defined in claim 2, wherein a non-condensable gas is charged in said vessel and covers the two layers of said thermal transfer medium and said liquid therein.

11. In a heat transfer device, the improvement comprising: a vessel having a heating section and a cooling section; a thermal transfer medium for transferring heat from said heating section to said cooling section; and a liquid body having a specific gravity smaller than said thermal transfer medium and being low in vapor pressure at a temperature corresponding to the boiling point of said thermal transfer medium, said liquid being not dissolvable in said thermal transfer medium; said thermal transfer medium and said liquid being charged in said vessel under an adequate pressure which is determined in accordance with an operating temperature of the device and a saturated vapor pressure of said thermal transfer medium, thereby forming two layers therein, a level of said liquid forming an upper layer of said two layers is maintained without being salient into said cooling section wherein heat transfer is effected by ebullition and condensation of said thermal transfer medium in which the medium condensed in said cooling section circulates by gravity into said heating section in which ebullition thereof takes place.

* * * * *